US012687302B2

(12) United States Patent
Brady et al.

(10) Patent No.: US 12,687,302 B2
(45) Date of Patent: Jul. 21, 2026

(54) LOCATING FEATURE FOR A HEAT APPARATUS OF A COOKTOP APPLIANCE

(71) Applicant: Haier US Appliance Solutions, Inc., Wilmington, DE (US)

(72) Inventors: Cassandra Brady, Louisville, KY (US); John Adam Yantis, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 591 days.

(21) Appl. No.: 18/302,478

(22) Filed: Apr. 18, 2023

(65) Prior Publication Data

US 2024/0353112 A1 Oct. 24, 2024

(51) Int. Cl.
*F24C 15/08* (2006.01)

(52) U.S. Cl.
CPC ..... *F24C 15/08* (2013.01)

(58) Field of Classification Search
CPC ..... F24C 15/08; F24C 15/12; F24C 3/08
USPC ..... 126/211, 1 R, 39 B, 39 E, 39 N, 39 R
See application file for complete search history.

(56) References Cited

U.S. PATENT DOCUMENTS 5,038,748 A 8/1991 Lockwood et al.
9,803,873 B2 * 10/2017 Rowley ..... F24C 15/006
2020/0248909 A1 8/2020 Lee et al.

FOREIGN PATENT DOCUMENTS

CN 204006162 U 12/2014
JP 6832565 B2 2/2021

* cited by examiner

*Primary Examiner* — Vivek K Shirsat
(74) *Attorney, Agent, or Firm* — Dority & Manning, P.A.

(57) ABSTRACT

A cooktop appliance that may include a cooktop. The cooktop may include a top panel and a recessed inner portion that may extend downward from the top panel along the vertical direction. Furthermore, the recessed inner portion may include one or more burner housings that may be defined within the recessed inner portion. The cooktop appliance may include one or more burner assemblies that may each be housed within a respective burner housing. Each burner assembly may output heat for the cooktop. Further, the cooktop appliance may include a heat apparatus that may include a heat plate, a diverter plate that extends downward from the heat plate approximately along the vertical direction, and a locator arm that extends outward from the heat plate. The locator arm may include a tab and a flange.

15 Claims, 6 Drawing Sheets

LOCATING FEATURE FOR A HEAT APPARATUS OF A COOKTOP APPLIANCE

FIELD

The present subject matter relates generally to oven appliances, and more particularly to locating features for a heat apparatus of the oven appliance.

BACKGROUND

Certain cooktop appliances may include a plurality of burners at a top panel of the cooktop appliance. The plurality of burners may output heat to cooking utensils, e.g., pots, pans, griddles, etc., placed on the top panel. In some cases, the plurality of burners may produce a large amount of thermal energy that raises the temperature of areas proximate the plurality of burners. For instance, the temperature of the ambient air surrounding the cooktop appliance, the temperature of surfaces of the cooktop appliance, and/or the temperature of surfaces surrounding the cooktop appliance, e.g., walls, countertops, cabinets, etc., may be undesirably raised.

Accordingly, a cooktop appliance with improved features for locating a heat apparatus to the cooktop appliance would be useful. More particularly, a locating feature for a heat apparatus that is capable of improving assembly of the cooktop appliance, such as improving ergonomics for an operator during assembly of the cooktop appliance, and increasing the reliability of the heat apparatus, e.g., to manage the temperature of the cooktop appliance, would be useful.

BRIEF DESCRIPTION

Aspects and advantages of the invention will be set forth in part in the following description, or may be apparent from the description, or may be learned through practice of the invention.

In one exemplary embodiment, a cooktop appliance is provided. The cooktop appliance may define a vertical direction, a lateral direction, and a transverse direction. More particularly, the cooktop appliance may include a cooktop that includes a top panel and a recessed inner portion. The recessed inner portion may extend downward from the top panel along the vertical direction. The recessed inner portion may extend between a front side and a back side along the transverse direction and a left side and a right side along the lateral direction. In addition, the recessed inner portion may include one or more burner housings defined within the recessed inner portion. In addition, the cooktop appliance may include one or more burner assemblies that are each housed within a respective burner housing. Each burner assembly may output heat for the cooktop. Further, the cooktop appliance may include a first heat apparatus.

The first heat apparatus may include, a first heat plate, a first diverter plate and a first locator arm. The first heat plate may be in intimate contact with the first side of the recessed inner portion. The first diverter plate may extend vertically downward from the first heat plate. The first locator arm may extend laterally outward from the first heat plate. Moreover, the first locator arm may include a first tab and a first flange. The first flange may be located to the cooktop by the first tab. Furthermore, the first heat apparatus may be coupled to the cooktop at the first flange. In addition, the cooktop appliance may include a second heat apparatus. The second heat apparatus may include a second heat plate, a second diverter plate, and a second locator arm. The second heat plate may be in intimate contact with the second side of the recessed inner portion. The second diverter plate may extend vertically downward from the second heat plate. The second locator arm may extend laterally outward from the second heat plate. Moreover, the second locator arm may include a second tab and a second flange. The second flange may be located to the cooktop by the second tab. Furthermore, the second heat apparatus may be coupled to the cooktop at the second flange.

In another exemplary embodiment, a cooktop appliance is provided. The cooktop appliance may define a vertical direction, a lateral direction, and a transverse direction. Further, the cooktop appliance may include a cooktop. The cooktop may include a top panel and a recessed inner portion. The recessed inner portion may extend downward from the top panel along the vertical direction. The recessed inner portion may extend between a front side and a back side along the transverse direction and a left side and a right side along the lateral direction. Furthermore, the recessed inner portion may include one or more burner housings that may be defined within the recessed inner portion. In addition, the cooktop appliance may include one or more burner assemblies that may each be housed within a respective burner housing. Each burner assembly may output heat for the cooktop. Further, the cooktop appliance may include a heat apparatus that includes a heat plate, a diverter plate, and a locator arm. The heat plate may be in intimate contact with the recessed inner portion. The diverter plate may extend vertically downward from the heat plate. The locator arm may extend laterally outward from the heat plate and may include a tab and a flange. The flange may be located to the cooktop by the tab. Moreover, the heat apparatus may be coupled to the cooktop by the flange.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
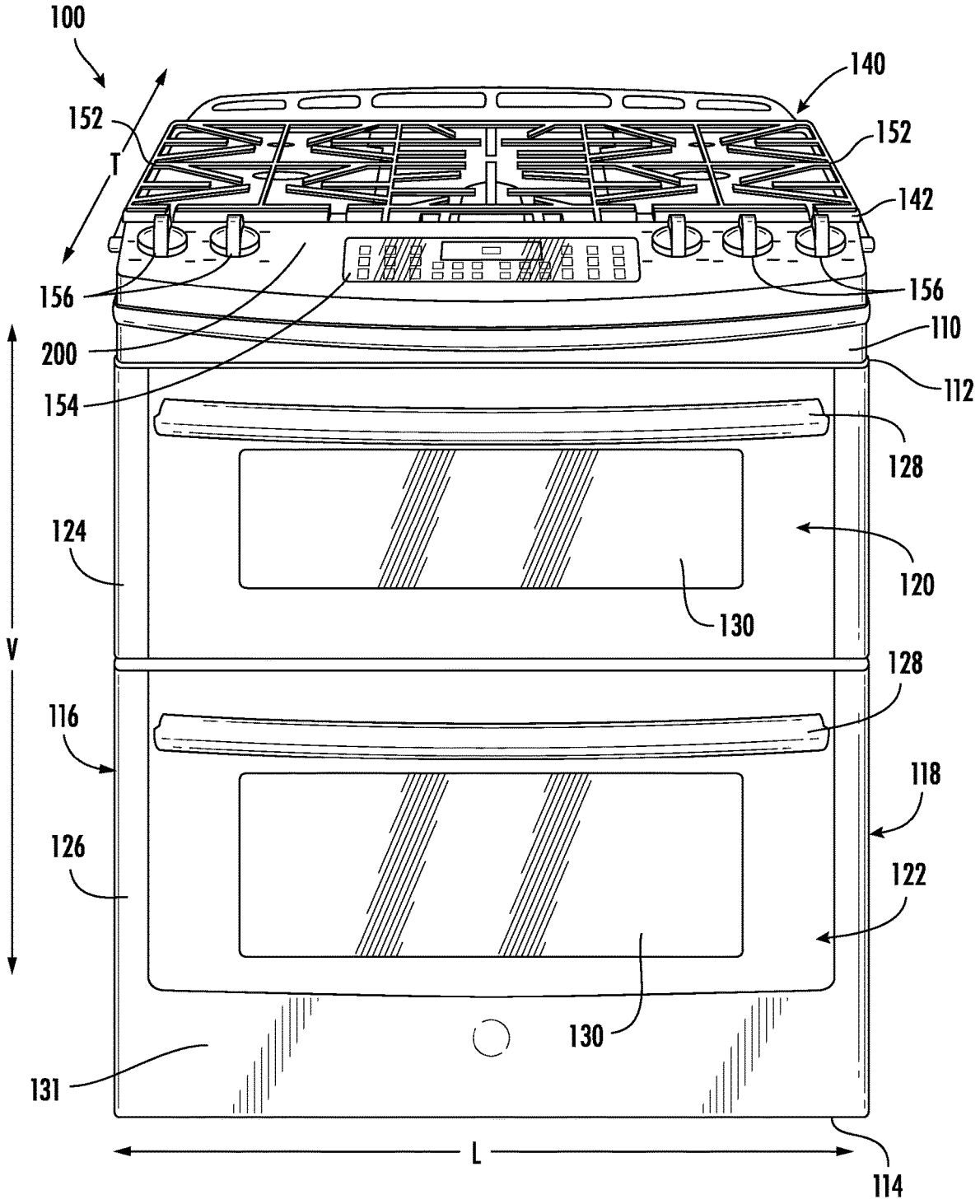
FIG. 1 is a front perspective view of an oven appliance in accordance with one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent margin.

Figure 2:
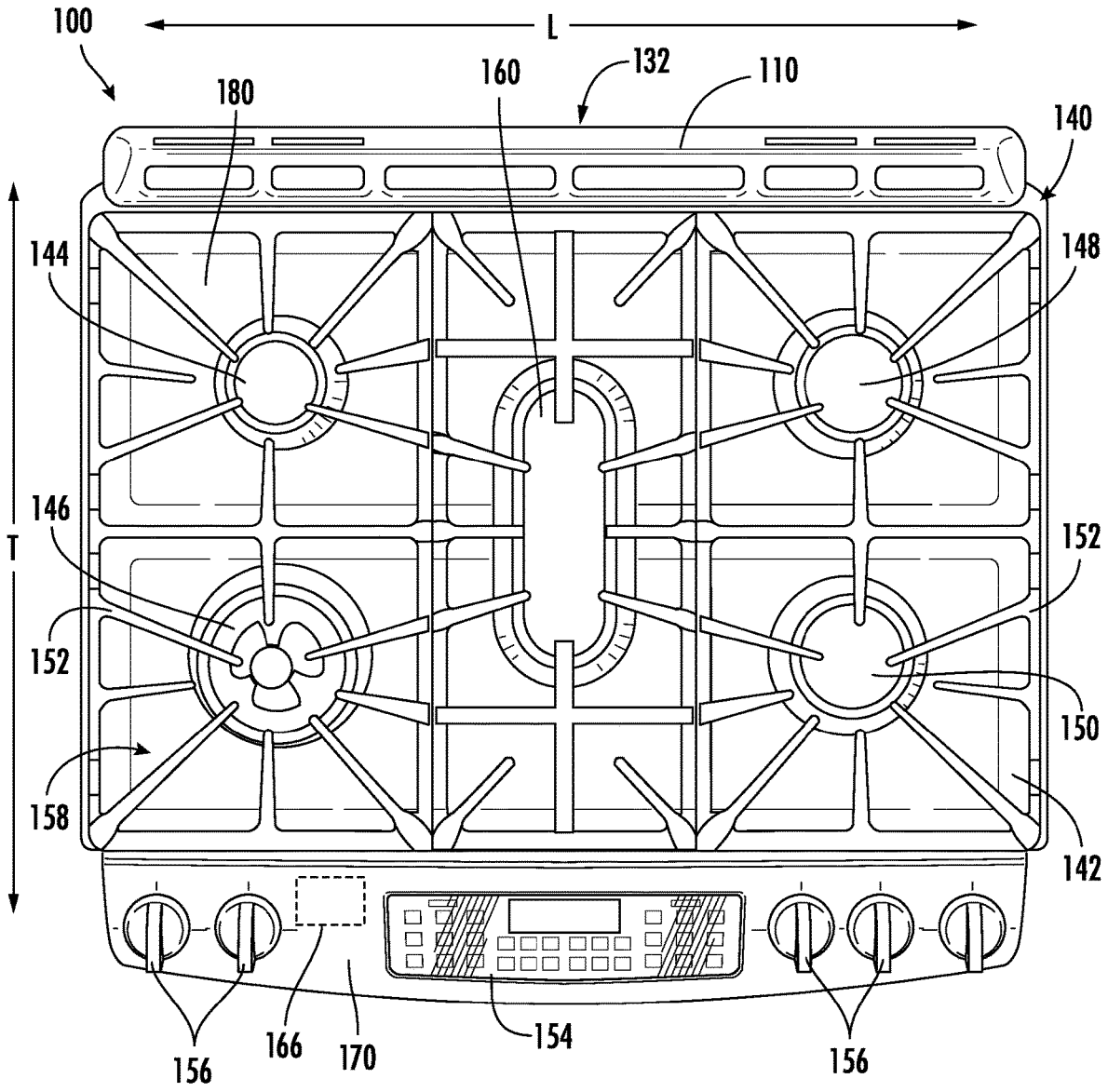
FIG. 2 is a top down view of the oven appliance of FIG. 1, in accordance with one or more exemplary embodiments of the present disclosure.

FIGS. 1 and 2 illustrate an exemplary oven appliance 100 which, as described further below, includes a cooktop 140. Thus, the oven appliance 100 is an example embodiment of a cooktop appliance. FIG. 1 provides a front perspective view of the oven appliance 100 in accordance with one or more exemplary embodiments of the present subject matter. FIG. 2 provides a top down view of the oven appliance 100 of FIG. 1 in accordance with one or more exemplary embodiments of the present subject matter. In some embodiments, the oven appliance 100 may define a vertical direction V, a lateral direction L, and a transverse direction T. The vertical direction V, the lateral direction L, and the transverse direction T are mutually perpendicular as to form an orthogonal direction system.

Furthermore, the oven appliance 100 may include an insulated cabinet 110. As illustrated, the cabinet 110 may extend between a top portion 112 and a bottom portion 114 approximately along the vertical direction V, between a first side 116 (e.g., the left side when viewed from the front as in FIG. 1) and a second side 118 (e.g., the right side when viewed from the front as in FIG. 1) approximately along the lateral direction L, and between a front 131 and a rear 132 approximately along the transverse direction T. In general, terms such as "left," "right," "front," "rear," "top," or "bottom" may be used with reference to the perspective of a user accessing oven appliance 100, e.g., standing in front of the oven appliance 100 to access the doors, inputs, etc., of the oven appliance 100.

In some embodiments, the cabinet 110 may define an upper cooking chamber 120 and a lower cooking chamber 122. Thus, the oven appliance 100 may generally be referred to as a double oven appliance. As will be understood by those skilled in the art, the oven appliance 100 is provided by way of example only, and the present subject matter may be used in any suitable appliance, e.g., a single oven appliance or a standalone cooktop appliance. Thus, the example embodiment shown in FIG. 1 is not intended to limit the present subject matter to any particular cooking chamber configuration or arrangement, or even the presence of a cooking chamber at all, e.g., cooktop appliances according to the present subject matter may include various forms of oven appliances as well as standalone cooktop appliances which do not include a cooking chamber.

The upper cooking chamber 120 and the lower cooking chamber 122 may be configured for the receipt of one or more food items to be cooked. In addition, the oven appliance 100 may include an upper door 124 and a lower door 126 rotatably attached to cabinet 110 in order to permit selective access to the upper cooking chamber 120 and the lower cooking chamber 122, respectively. Further, handles 128 may be mounted to the upper door 124 and the lower door 126, respectively, to assist a user with opening and closing the upper door 124 and the lower door 126 in order to access the upper cooking chamber 120 and the lower cooking chamber 122. As an example, a user can pull on handle 128 mounted to the upper door 124 to open or close the upper door 124 and access the upper cooking chamber 120. In addition, glass window panes 130 may provide for viewing the contents of the upper cooking chamber 120 and the lower cooking chambers 122 when the upper door 124 and the lower door 126 are closed and also may assist with insulating the upper cooking chamber 120 and the lower cooking chamber 122. Heating elements (not shown), such as electric resistance heating elements, gas burners, microwave heating elements, halogen heating elements, or suitable combinations thereof, may be positioned within the upper cooking chamber 120 and the lower cooking chamber 122 for heating the upper cooking chamber 120 and the lower cooking chamber 122.

In some embodiments, the oven appliance 100 may also include a cooktop 140 positioned at or adjacent a top portion of cabinet 110. Thus, the cooktop 140 may be positioned above the upper cooking chamber 120 and lower cooking chamber 122. The cooktop 140 may include a top panel 142 and a recessed inner portion 180 that is configured to house one or more burner assemblies, such as a first burner assembly 144, a second burner assembly 146, a third burner assembly 148, a fourth burner assembly 150, and a griddle burner assembly 160. In addition, the oven appliance 100 may include grates 152 that are supported on a top surface 158 of the top panel 142. The grates 152 may be configured to hold cooking utensils, e.g., pots, pans, griddles, etc., at a location above the one or more burner assemblies.

Each of the burner assemblies may be configured to output heat, e.g., to heat the cooking utensils. For instance, each burner assembly may produce a flow of thermal energy, such as through the combustion of fuel, that may heat the cooking utensil located above the respective burner assembly. The flow of thermal energy may heat the cooking utensil through various methods of heat transfer, such as radiation and/or conduction. For example, the first burner assembly 144 may output heat to heat a cooking utensils located on grates 152 above the respective burner assembly.

In some embodiments, such as FIGS. 1 and 2, the one or more burner assemblies may be configured in various sizes to provide various heat outputs, e.g., various flows of thermal energy, and additionally may be configured to accommodate cooking utensils of various sizes and configurations.

The oven appliance 100 may additionally include a user interface panel 154 that may be located within convenient reach of a user of the oven appliance 100. In some embodiments, the user interface panel 154 may include knobs 156 that are each associated with the one or more of the burner assemblies, e.g., burner assemblies 144, 146, 148, 150, and the griddle burner 160, respectively. Knobs 156 may allow the user to activate each burner assembly and determine the amount of heat output provided by each burner assembly. In some instances, the user interface panel 154 may also be provided with one or more graphical display devices that deliver certain information to the user such as whether a particular burner assembly is activated and/or the flow rate at which the burner assembly is set.

Although shown with knobs 156, it should be understood that knobs 156 and the configuration of oven appliance 100 shown in FIG. 1 is provided by way of example only. More specifically, the user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

For instance, the oven appliance 100 may further include or be in operative communication with a processing device or a controller 166 that may be generally configured to facilitate appliance operation. In this regard, the user interface panel 154, knobs 156, and the display may be in communication with the controller 166 such that the controller 166 may receive control inputs from knobs 156, may display information using the display, and may otherwise regulate operation of the oven appliance 100. For example, signals generated by the controller 166 may operate the oven appliance 100, including any or all system components, subsystems, or interconnected devices, in response to the position of knobs 156 and other control commands. The user interface panel 154 and other components of the oven appliance 100 may be in communication with the controller 166 via, for example, one or more signal lines or shared communication busses. In this manner, Input/Output ("I/O") signals may be routed between controller 166 and various operational components of the oven appliance 100.

Figure 3:
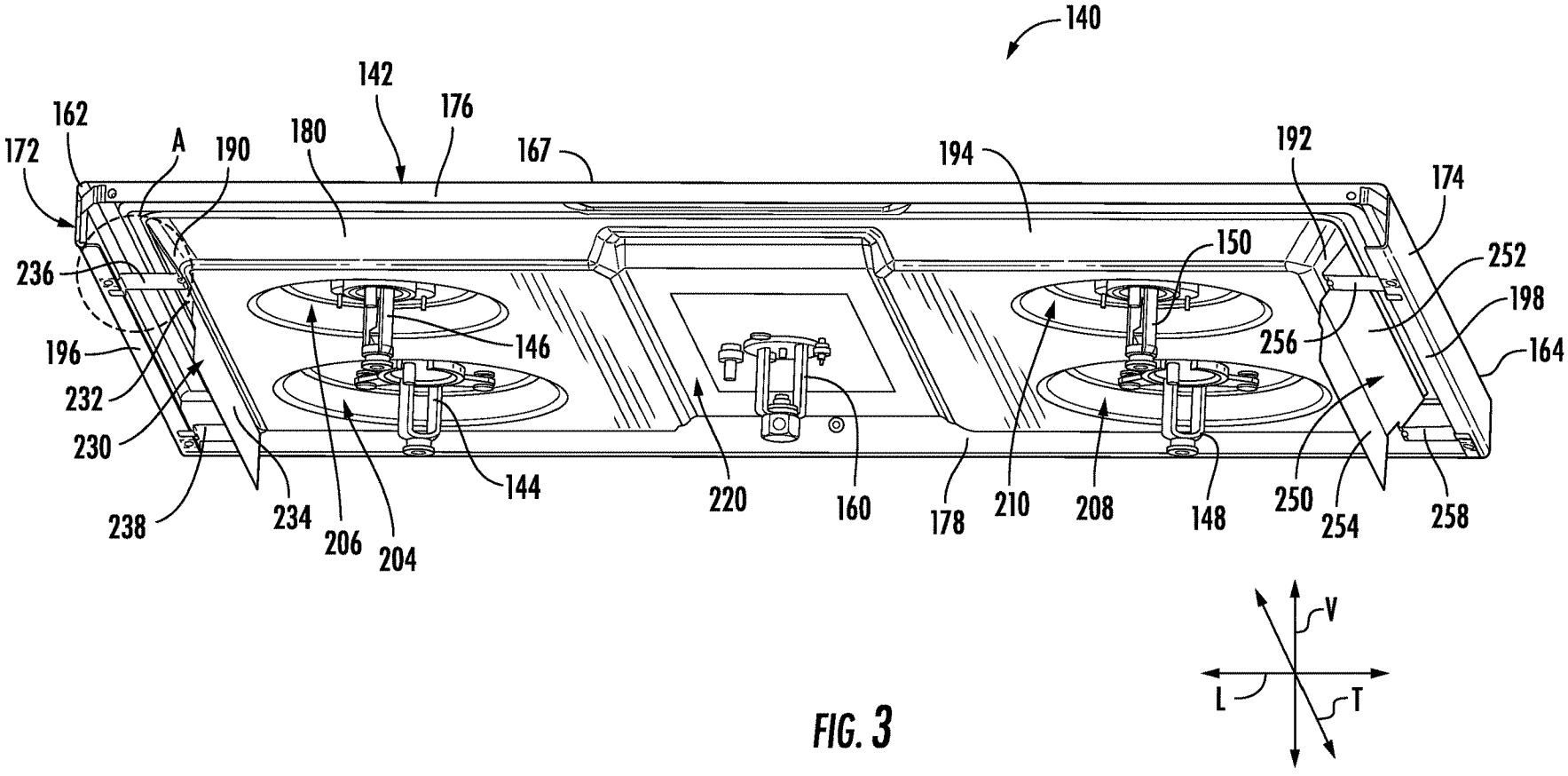
FIG. 3 is a perspective view of a cooktop in accordance with one or more exemplary embodiments of the present disclosure.

Referring now to FIG. 3, a perspective view of the cooktop 140 in accordance with one or more exemplary aspects of the present subject matter is provided, e.g., the exemplary cooktop 140 of FIG. 3 may be incorporated in an oven appliance, such as the oven appliance 100 described above, another suitable oven appliance, or the exemplary cooktop 140 of FIG. 3 may be a standalone cooktop appliance, such as may be mounted in or on a counter without any cooking chambers directly attached to or integrated with the cooktop. As briefly mentioned above, the cooktop 140 may include a top panel 142. The top panel 142 may extend between a left edge 162 and a right edge 164 approximately along the lateral direction L and a front edge 167 and a rear edge (not shown) approximately along the transverse direction T. The left edge 162, the right edge 164, the front edge 167, and the rear edge may define the shape of the top panel 142. Moreover, the cooktop 140 may include a left trim piece 172, a right trim piece 174, a front trim piece 176, and a rear trim piece 178 that each may extend vertically downward, e.g., downward with respect to the vertical direction V, from the respective edge, e.g., left edge 162, right edge 164, front edge 167, and rear edge, of the top panel 142. For example, the left trim piece 172 may extend vertically downward from the top panel 142, and more specifically vertically downward from the left edge 162 thereof. In addition, the cooktop 140 may include a left lip 196 that may extend laterally inward from the left trim piece 172 toward the recessed inner portion 180 and a right lip 198 that may extend laterally inward from the right trim piece 174 toward the recessed inner portion 180.

The recessed inner portion 180 may extend between a left side 190 and a right side 192 approximately along the lateral direction L and between a front side 194 and a back side (not shown) approximately along the transverse direction T. In some embodiments, the left side 190 may extend vertically downward and laterally inward toward the first and second burner assemblies 144, 146 such that the left side 190 may be slanted toward the center of the recessed inner portion 180, e.g., at an oblique angle to each of the vertical direction V and the lateral direction L. Similarly, the right side 192 may extend vertically downward and laterally inward toward the third and fourth burner assemblies 148, 150 such that the right side 192 may be slanted toward the center of the recessed portion 180.

In addition, the recessed inner portion 180 may define one or more burner housings, such as a first burner housing 204, a second burner housing 206, a third burner housing 208, a fourth burner housing 210, and a griddle burner housing 220, positioned between the left side 190 and the right side 192, e.g., along the lateral direction L, and between the front side 194 and the back side 195, e.g., along the transverse direction T. The burner housing or each burner housing may house, e.g., accommodate the shape and size of, a respective burner assembly. For example, the first burner housing 204 may house the first burner assembly 144, the second burner housing 206 may house the second burner assembly 146, the third burner housing 208 may house the third burner assembly 148, the fourth burner housing 210 may house the fourth burner assembly 150, and the griddle burner housing 220 that may house a griddle burner assembly 160.

As will be understood by those skilled in the art, each burner housing may be shaped in any suitable manner as to house the respective burner assembly. For example, the first burner housing 204 may be circular shaped to house the first burner assembly 144. As another example, the griddle burner housing 220 may be rectangular shaped to house the rectangular shaped griddle burner assembly 160.

Moreover, as will also be understood by those skilled in the art, any suitable number of burner housings may be provided to house any suitable number of burner assemblies. For example, in additional embodiments only two burner housings may be provided to house only two burner assemblies, or more than five burner housings may be provided, e.g., six or more burner housings may be provided to house six or more burner assemblies.

In some instances, such as during operation of the oven appliance 100, the heat outputted by the one or more burner assemblies may also increase the temperature of the areas proximate the one or more burner assemblies, e.g., due to the thermal energy produced. In such instances, the temperature of recessed inner portion 180 may increase, for instance, surfaces of the recessed inner portion 180, e.g., the left side 190 and the right side 192, may increase. To manage the temperature of the recessed inner portion 180 the oven appliance 100 may additionally include one or more heat apparatuses each positioned on a respective side of the recessed inner portion 180.

Moreover, in some instances, the one or more heat apparatuses each may be positioned on a respective side(s) of the recessed inner portion 180 that may be proximate a high heat output burner assembly. For instance, in some embodiments, a discrete first heat apparatus may be positioned on either the front side 194, the back side 195, the left side 190, or the right side 192 of the recessed inner portion 180, e.g., to manage the temperature of the recessed inner portion 180. In addition, in some embodiments, a discrete second heat apparatus may be positioned on a side opposite or adjacent to the first discrete heat apparatus.

For example, in some embodiments, the first heat apparatus may be positioned on the front side 194 of the recessed inner portion 180 and the second heat apparatus may be positioned on the opposing back side 195 of the recessed inner portion 180. As another example, in some embodiments, the first heat apparatus may be positioned on the left side 190 and the second heat apparatus may be positioned on and adjacent side of the recessed inner portion 180, such as the front side 194 or the back side 195. In addition, in some embodiments, a discrete heat apparatus may be positioned on each side of the recessed inner portion 180, such as discrete heat apparatuses positioned on the front side 194, the back side 195, the left side 190, and the right side 192 of the recessed inner portion 180.

In particular, the exemplary oven appliance 100 may include a first heat apparatus, e.g., left heat apparatus 230 and a second heat apparatus, e.g., right heat apparatus 250 that may be formed of a thermally conductive material, such as a metal material, e.g., copper, aluminum, zinc, and/or other similar metal materials including alloys thereof. The left heat apparatus 230 and the right heat apparatus 250 may each include a heat plate, such as a left heat plate 232 and a right heat plate 252, that may function as a heat sink, e.g., to dissipate thermal energy away from the recessed inner portion 180. The left heat plate 232 may be positioned approximately parallel to the left side 190 of the recessed inner portion 180 and the right heat plate 252 may be positioned approximately parallel to the right side 192 of the recessed inner portion 180. More specifically, the left heat plate 232 may be in intimate contact with the left side 190 of the recessed inner portion 180 and the right heat plate 252 may be in intimate contact with the right side 192 of the recessed inner portion 180.

The term "intimate contact" herein may refer to direct contact, e.g., contact without the presence of any intervening structures, between two parallel surfaces, e.g., such that the surfaces are touching over at least a portion of each surface such as over a majority of each surface, such as over about ninety percent (90%) or more of each surface, which may allow the two surfaces to be in direct thermal communication, e.g., to transfer heat, such as by conduction through the surface-to-surface interface of the components which are in "intimate contact." For example, the left heat plate 232 and the left side 190 of the recessed inner portion 180 may be in intimate contact such that the left heat plate 232 may transfer heat, such as dissipate thermal energy produced by the one or more burner assemblies, away from the recessed inner portion 180.

Moreover, in some embodiments, one or more locator arms (described in more detail below) of the left heat apparatus 230 and the right heat apparatus 250, may apply a force to the left heat plate 232 and the right heat plate 252 to facilitate and improve the "intimate contact" between the left heat plate 232 and the left side 190 of the recessed inner portion 180 and between and right heat plate 252 and the right side 192 of the recessed inner portion 180. For instance, the one or more locator arms may bear against the cooktop 140, e.g., in the lateral direction, and apply an equal and opposite force in the lateral direction, that may facilitate "intimate contact" between a respective heat plate and a respective side of the recessed inner portion 180. In additional instances, the force may be a spring force, as the one or more locator arms may be bent from the respective heat plate and held in compression by the cooktop 140. In such a position, the one or more locator arms may act as a spring and may exert an equal and opposite force, e.g., a "spring force", that may facilitate "intimate contact" between a respective heat plate and a respective side of the recessed inner portion 180.

Additionally, the left heat apparatus 230 and the right heat apparatus 250 may each include a diverter plate, such as left diverter plate 234 and right diverter plate 254. The left diverter plate 234 may extend vertically downward from the left heat plate 232 and the right diverter plate 254 may extend vertically downward from the right heat plate 252. When one or more of the burner assemblies is or are activated, the burner assembly (or each burner assembly when more than one are activated) may generate combustion products such as a flames and heated gases. The combustion products, e.g., heated gases, may travel outward from the active burner assembly(ies), thereby heating surrounding areas, such as by convection via the flow of heated gases. The vertically downward extension of the left diverter plate 234 and the right diverter plate 254 may place the left diverter plate 234 and the right diverter plate 254 in convective thermal communication with the flow of heated gases that may be produced or emanated from the active burner assembly(ies). For instance, the combustion products, e.g., heated gases, that may travel over the left diverter plate 234 and the right diverter plate 254 may transfer thermal energy, e.g., heat, to the left diverter plate 234 and the right diverter plate 254.

Moreover, the vertically downward extension of the left diverter plate 234 and the right diverter plate 252 may be configured to divert the flow of the combustions products away from the areas where heating is not desired, such as external surfaces of the cooktop appliance 100 and/or adjoining areas around the cooktop appliance 100. For example, the flow of combustion products that may be produced or emanated from the first burner assembly 146, e.g., when the first burner assembly 146 is active, may travel across a laterally inward surface of the left diverter plate 234 toward the back side of the cooktop 140.

In addition, the left heat apparatus 230 may include a front left locator arm 236 and a back left locator arm 238. Similarly, the right heat apparatus 250 may include a front right locator arm 256 and a back right locator arm 258. The front left locator arm 236 and the front right locator arm 256 may be positioned proximate the front side 194 of the recessed inner portion 180, e.g., closer to the front side 194 of the recessed inner portion 180 than to the back side of the recessed inner portion, and the back left locator arm 238 and the back right locator arm 258 may be positioned proximate the back side of the recessed inner portion, e.g., closer to the back side of the recessed inner portion 180 than to the front side 194 of the recessed inner portion 180.

Figure 4:
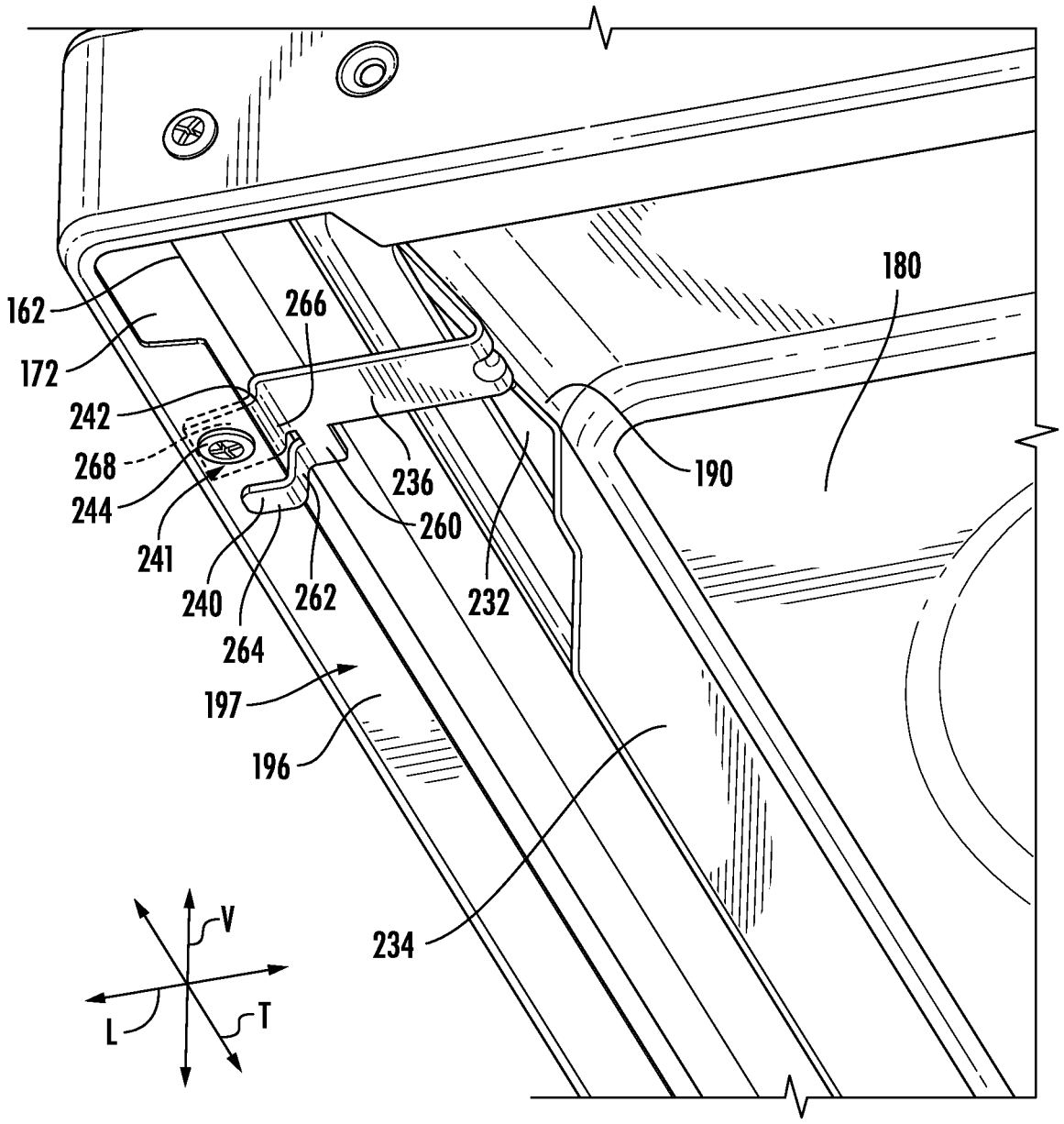
FIG. 4 is a close-up perspective view of the cooktop of FIG. 3 taken generally from portion A in accordance with one or more exemplary aspects of the present disclosure.
Figure 5:
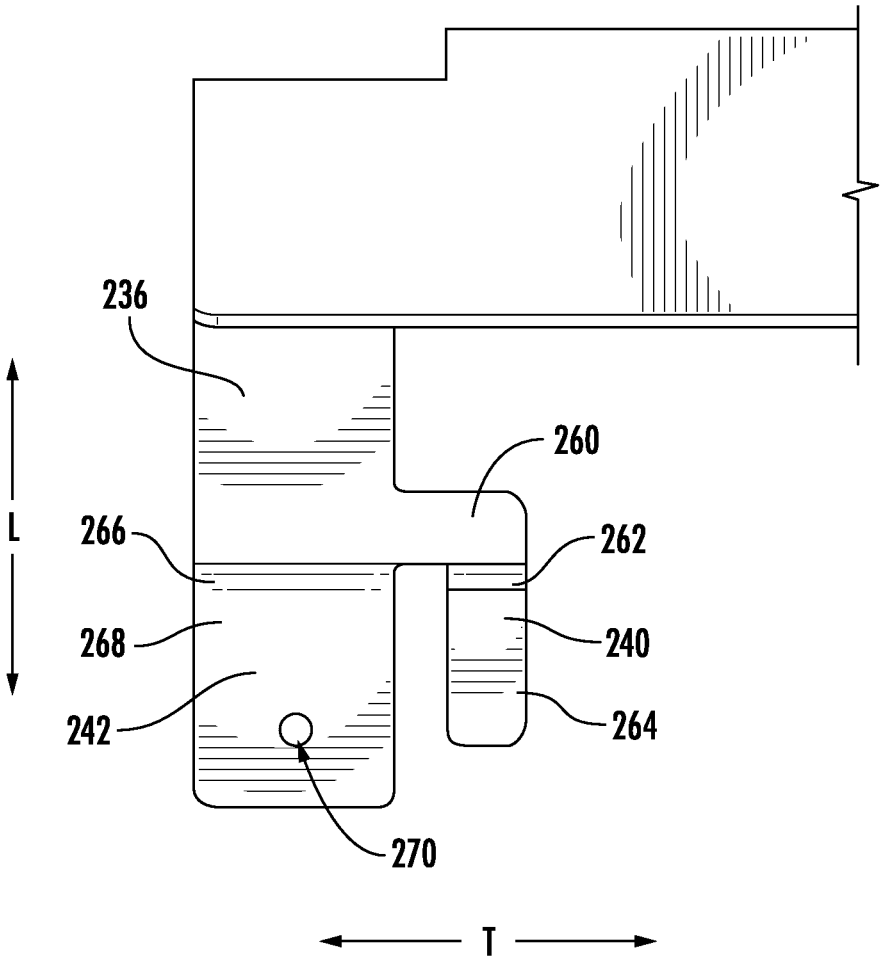
FIG. 5 is a top down view of a locator arm in accordance with one or more exemplary embodiments of the present disclosure.

Referring now to FIGS. 4 and 5, FIG. 4 provides a close-up perspective view of the front left locator arm 236 taken generally from portion A (as indicated in FIG. 3) and FIG. 5 provides a top down perspective view of the front left locator arm 236 in accordance with one or more exemplary aspects of the present subject matter. As shown, the front left locator arm 236 may extend laterally outward from the left heat plate 232 toward the left trim piece 172. More specifically, the front left locator arm 236 may be bent from the left heat plate 232 at an acute angle such that the front left locator arm 236 may extend laterally outward from the left heat plate 232 toward the left trim piece 172.

Moreover, the front left locator arm 236 may include a front left tab 240 that may be interfaced with an outer surface 197 of the left lip 196. In some embodiments, the front left tab 240 may include a double bend that may allow the front left tab 240 to be interfaced with the outer surface 197. For instance, as depicted in FIGS. 4 and 5, the front left tab 240 may include a first tab member 260 that may be perpendicular to the left locator arm 236, e.g., the first tab member 260 may extend transversely inward from the left locator arm 236 toward the back side of the cooktop 140. The front left tab 240 may further include a second tab member 262 that may extend from the first tab member 260 toward the left lip 196, e.g., vertically downward from the first tab member 260. In addition, the front left tab 240 may include a third tab member 264 that may extend from the second tab member 264 toward the left trim piece 172, e.g., laterally outward from the second tab member 264 toward the left trim piece 172.

In addition, the front left locator arm 236 may include a front left flange 242 that may be interfaced with an inner surface (not depicted) of the left lip 196. Similar to the front left tab 240, in some embodiments, the front left flange 242 may include a double bend. However, the double bend of the front left flange 242 may allow the front left flange 242 to be interfaced with the inner surface of the left lip 196. For instance, the front left flange 242 may include a first flange member 266 that may extend from the front locator arm 236 toward the left lip, e.g., vertically downward from the front left locator arm 236. In addition, the front left flange 242 may include a second flange member 268 that may extend from the first flange member 266 toward the left trim piece 172, e.g., laterally outward from the first flange member 266. Further, the flange 242 may include a bite hole 270 defined through the front left flange 242.

In some embodiments, the left heat apparatus 230 may be coupled to the cooktop 140 at the front left flange 242. In particular, the left heat apparatus 230 may be coupled to the left lip 196 of the cooktop 140 at the front left flange 242. In some embodiments, the front left flange 242 may be mechanically coupled to the left lip 196, via a fastener 244, e.g., a bolt, a rivet, a screw, etc.

During assembly of the cooktop appliance 100, and more particularly, the cooktop 140, the front left flange 242 may be located to the cooktop 140 by the front left tab 240 interfacing with the left lip 196. Particularly, the front left flange 242 may be located to the cooktop 140 such that the front left flange 242 may be properly coupled to the cooktop 140, e.g., during assembly of the cooktop 140 For instance, the front left flange 242 may be located to the cooktop 140 such that an engagement hole defined through the left lip 196 and the bite hole 270 of the front left flange are approximately aligned for proper coupling of the front left flange 242 and the cooktop 140. The alignment of the engagement hole and the bite hole 270 may be concentric such that a center of the engagement hole and a center of the bite hole 270 approximately aligned, e.g., a displacement of the center of the engagement hole from the center of the bite hole 270 may be ten percent or less of a diameter of the bite hole 270.

Moreover, the interfaced front left tab 240 and outer surface 197 may provide a visual alignment for an operator during assembly of the cooktop appliance 100. For example, the front left tab 240 may be visible to an operator during assembly of the cooktop appliance 100 as the front left tab 240 may be interfaced with a surface, e.g., the outer surface 197, that may be visible to the operator during assembly, while the front left flange 242 may not be visible to the operator during assembly as the front left flange 242 may be interfaced with a surface, e.g., the inner surface, that may not be visible to the operator during assembly.

In addition, the front left tab 240 may be configured to hold the front left flange 242 in place during assembly of the oven appliance 100. For instance, the front left tab 240 may be rigid enough to prevent the front left flange 242 from rotating away from the left lip 196, such as rotating inward relative to the left lip 196, when the fastener 244 is being driven during assembly. As such, the term "locate" (when used as a verb and including cognates thereof such as "locating") may herein refer to a tab, such as the front left tab 240, positioned and configured to align a flange, such as the front left flange 242, to the cooktop 140 during assembly of the cooktop 140, and particularly, during the coupling of a flange to a corresponding lip of the cooktop 140, for instance the left lip 196, e.g., visually locating as described above.

It should be appreciated that for clarity and brevity, FIG. 4 depicts only the front left locator arm 236. As will be understood by those skilled in the art, though not depicted, the back left locator arm 238, the front right locator arm 256 and the back right locator arm 258 may each similarly include a tab that locates a flange to the respective lip of the cooktop 140 such that the flange may be coupled to the respective lip of the cooktop 140. For example, the front right locator arm 256 may include a front right tab that may locate a front right flange to the right lip 198. In addition, the front right flange may couple the front right locator arm 256 to the right lip 198.

As will be understood by those skilled in the art, in additional embodiments, the left heat apparatus 230 and the right heat apparatus 250 may include only one locator arm, or may include more than two locator arms, e.g., three or more locator arms may be provided, such as a middle locator arm approximately equidistant along the transverse direction T between the front locator arms, e.g., the front left locator arm 236 and the front right locator arm 256, and the back locator arm, e.g., the back left locator arm 238 and the back right locator arm 258, shown and described herein.

In additional embodiments, each locator arm may include more than one tabs that each may locate the respective heat apparatus to the cooktop 140. For example, referring now to FIG. 6, a top down view of a locator arm 300 in accordance with another exemplary aspect of the present disclosure is provided. The exemplary locator arm 300 of FIG. 6 may be configured in substantially the same manner as the exemplary front left locator arm 236 of FIG. 5, and accordingly, the same or similar numbers may refer to the same or similar parts.

Figure 6:
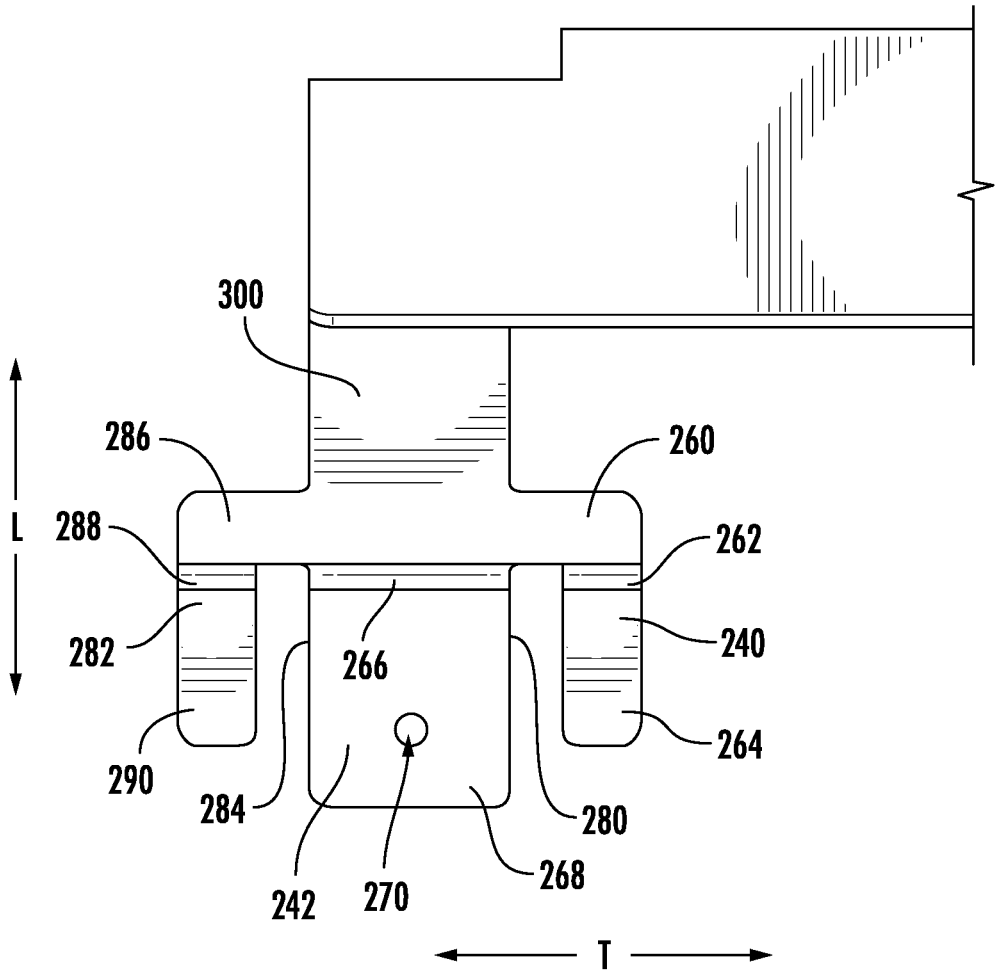
FIG. 6 is a top down view of a locator arm in accordance with one or more exemplary embodiments of the present disclosure.

For example, the exemplary locator arm 300 of FIG. 6 generally includes a tab 240 that may include a first tab member 260, a second tab member 262, and a third tab member 264. Additionally, the locator arm 300 may include a flange 242 that may include a first flange member 266, a second flange member 268, and a bite hole 270. However, for the embodiment of FIG. 6, the tab 240 is now configured as an inner tab 240 that may extend from an inner edge 280 and the locator arm 300 further includes an outer tab 282 that may extend from an outer edge 284 of the locator arm 300.

In some embodiments, the outer tab 282 may include a fourth tab member 286 that may be perpendicular to locator arm 300, e.g., the fourth tab member 286 may extend transversely outward from the locator arm 300 toward the front side 194 of the cooktop 140. In addition, the outer tab 282 may include a fifth tab member 288 that may extend from the fourth tab member 286 toward the left lip 196, e.g., vertically downward from the fourth tab member 286. Further the outer tab 282 may include a sixth tab member 290 that may extend from the fifth tab member 288 toward a respective trim piece, e.g., laterally outward from the fifth tab member 288 toward the respective trim piece.

Embodiments of the cooktop 140 provided herein may advantageously provide improved assembly of the cooktop 140, for instance, by adding tabs, e.g., tab 240, to each locator arm, the locator arm may be used to locate the one or more heat apparatuses, e.g., the left heat apparatus 230 and the right heat apparatus 250, to the cooktop 140 during assembly of the cooktop 140. Additionally, such tabs may ensure that each of the flanges, e.g., flange 242, stay approximately parallel to the respective lip of the cooktop 140 during assembly of the cooktop 140. Additionally, such tabs may act as a visual indicator to aid an operator in aligning the bite hole 270 defined through the respective flange 242 and a respective engagement hole defined through a lip, e.g., the left lip 196 and the right lip 198, of the cooktop 140.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance defining a vertical direction, a lateral direction, and a transverse direction, the cooktop appliance comprising:

a cooktop comprising a top panel, a recessed inner portion, a first trim piece, and a first lip, the recessed inner portion extending downward from the top panel along the vertical direction, the recessed inner portion comprising one or more burner housings defined within the recessed inner portion, the first trim piece extending vertically downward from the top panel, the first lip extending laterally inward from the first trim piece towards the recessed inner portion, the first lip comprising an engagement hole defined through the first lip;

one or more burner assemblies each housed within a respective burner housing, wherein each burner assembly is configured to output heat for the cooktop;

a first heat apparatus on a first side of the recessed inner portion, the first heat apparatus comprising a first heat plate, a first diverter plate, and a first locator arm, the first heat plate in intimate contact with the first side of the recessed inner portion, the first diverter plate extending vertically downward from the first heat plate, the first locator arm extending laterally outward from the first heat plate and comprising a first tab and a first flange comprising a bite hole defined through the first flange, wherein the first tab locates the first flange on the cooktop by interfacing with the first lip, wherein the engagement hole and the bite hole are aligned by the first tab during assembly of the cooktop appliance, and wherein the first heat apparatus is coupled to the cooktop at the first flange; and a second heat apparatus on a second side of the recessed inner portion, the second heat apparatus comprising a second heat plate, a second diverter plate, and a second locator arm, the second heat plate in intimate contact with the second side of the recessed inner portion, the second diverter plate extending vertically downward from the second heat plate, the second locator arm extending laterally outward from the second heat plate and comprising a second tab and a second flange, wherein the second tab locates the second flange on the cooktop, and wherein the second heat apparatus is coupled to the cooktop at the second flange.

2. The cooktop appliance of claim 1, wherein the first heat apparatus is mechanically coupled to the cooktop at the first flange.

3. The cooktop appliance of claim 1, wherein the cooktop comprises a second trim piece and a second lip, wherein the second trim piece extends vertically downward from the top panel, wherein the second lip extends laterally inward from the second trim piece towards the recessed inner portion, and wherein the second flange is located to the cooktop by the second flange interfacing with the second lip.

4. The cooktop appliance of claim 3, wherein the second lip comprises an engagement hole defined through the second lip, wherein the second flange comprises a bite hole defined through the second flange, and wherein the engagement hole and the bite hole are aligned by the second tab during assembly of the cooktop appliance.

5. The cooktop appliance of claim 3, wherein the second heat apparatus is mechanically coupled to the cooktop at the second flange.

6. The cooktop appliance of claim 1, wherein the first tab comprises a first tab member that is perpendicular to the first locator arm, a second tab member that extends vertically downward from the first tab member, and a third tab member that extends laterally outward from the second tab member toward the first trim piece.

7. The cooktop appliance of claim 1, wherein the second tab comprises a first tab member that is perpendicular to the second locator arm, a second tab member that extends vertically downward from the first tab member, and a third tab member that extends laterally outward from the second tab member.

8. The cooktop appliance of claim 1, wherein the first locator arm is a front first locator arm that extends laterally outward from the first heat plate at a location proximate a front side of the recessed inner portion, wherein the first heat apparatus further comprises a back first locator arm that extends laterally outward from the first heat plate at a location proximate a back side of the recessed inner portion, wherein the back first locator arm comprises a back first tab and a back first flange, wherein the back first flange is located to the cooktop by the back first tab, and wherein the back first locator arm is coupled to the cooktop at the back first flange.

9. The cooktop appliance of claim 1, wherein the second locator arm is a front second locator arm that extends laterally outward from the second heat plate at a location proximate a front side of the recessed inner portion, wherein the second heat apparatus further comprises a back second locator arm that extends from the second heat plate at a location proximate a back side of the recessed inner portion, wherein the back second locator arm comprises a back second tab and a back second flange, wherein the back second flange is located to the cooktop by the back second tab, and wherein the back second locator arm is coupled to the cooktop at the back second flange.

10. A cooktop appliance defining a vertical direction, a lateral direction, and a transverse direction, the cooktop appliance comprising:

a cooktop comprising a top panel, a recessed inner portion, a trim piece and a lip, the recessed inner portion extending downward from the top panel along the vertical direction, between a front side and a back side along the transverse direction, and between a left side and a right side along the lateral direction, the recessed inner portion comprising one or more burner housings defined within the recessed inner portion, the trim piece extending vertically downward from the top panel, the lip extending laterally inward from the trim piece towards the recessed inner portion, and the lip comprising an engagement hole defined through the lip;

one or more burner assemblies each housed within a respective burner housing, wherein each burner assembly outputs heat for the cooktop; and a heat apparatus comprising a heat plate, a diverter plate, and a locator arm, the heat plate being in intimate contact with the recessed inner portion, the diverter plate extending vertically downward from the heat plate, the locator arm extending laterally outward from the heat plate and comprising a tab and a flange comprising a bite hole defined through the flange, wherein the tab locates the flange on the cooktop by interfacing with the lip, wherein the engagement hole and the bite hole are aligned by the tab during assembly of the cooktop appliance and wherein the heat apparatus is coupled to the cooktop at the flange.

11. The cooktop appliance of claim 10, wherein the lip comprises an inner surface and an outer surface, wherein the tab and the outer surface are interfaced, and wherein the flange and the inner surface are interfaced.

12. The cooktop appliance of claim 10, wherein the heat apparatus is mechanically coupled to the cooktop at the flange.

13. The cooktop appliance of claim 10, wherein the tab comprises a first tab member that is perpendicular to the locator arm, a second tab member that extends vertically downward from the first tab member, and a third tab member that extends laterally outward from the second tab member toward the left side of the cooktop.

14. The cooktop appliance of claim 10, wherein the locator arm is a front locator arm that extends laterally outward from the heat plate at a location proximate the front side of the recessed inner portion, wherein the heat apparatus further comprises a back locator arm that extends laterally outward from the heat plate at a location proximate the back side of the recessed inner portion.

15. The cooktop appliance of claim 10, wherein the heat apparatus is a left heat apparatus is in intimate contact with the left side of the recessed inner portion and wherein the cooktop appliance further comprises a right heat apparatus is in intimate contact with the right side of the recessed inner portion.

* * * * *